US009655480B2

(12) United States Patent
Fang et al.

(10) Patent No.: US 9,655,480 B2
(45) Date of Patent: May 23, 2017

(54) FACIAL CLEANING BRUSH AND RELATED COMPONENTS

(71) Applicant: SHENZHEN COSBEAUTY CO., LTD, Nanshan, Shenzhen (CN)

(72) Inventors: Ziran Fang, Shenzhen (CN); Wanfu Huang, Shenzhen (CN)

(73) Assignee: Shenzhen CosBeauty Co., LTD., Shenzhen, GD (CN)

( * ) Notice: Subject to any disclaimer, the term of this patent is extended or adjusted under 35 U.S.C. 154(b) by 0 days.

(21) Appl. No.: 15/203,001

(22) Filed: Jul. 6, 2016

(65) Prior Publication Data

US 2017/0086627 A1 Mar. 30, 2017

(30) Foreign Application Priority Data

Sep. 25, 2015 (CN) ..... 2015 2 0750770 U

(51) Int. Cl.
*A46B 13/02* (2006.01)
*A47K 7/04* (2006.01)

(52) U.S. Cl.
CPC ..... *A47K 7/043* (2013.01); *A46B 13/02* (2013.01)

(58) Field of Classification Search
None
See application file for complete search history.

(56) References Cited

U.S. PATENT DOCUMENTS 3,346,748 A * 10/1967 McNair ..... H02K 33/04 15/22.1
4,203,431 A * 5/1980 Abura ..... A61H 7/005 15/28
6,575,924 B2 * 6/2003 Wevers ..... A46B 13/00 15/28

* cited by examiner

*Primary Examiner* — Randall Chin
(74) *Attorney, Agent, or Firm* — Mark C. Johnson; The IP Law Firm, PLLC

(57) ABSTRACT

A facial cleaning brush having an outer shell coupled with a brush head assembly with a brush head housing surrounding a motor head operably configured to supply power for a movement of the brush head, wherein the brush head assembly has a brush head having an anchoring plate with a plurality of bristles coupled to a front face of the anchoring plate that includes a first anchoring point, and also has at least two U-shaped springs coupled to the anchoring plate and a brush head anchoring unit with a second anchoring point selectively removably coupled to the first anchoring point, wherein the first and second anchoring points are interposed between the at least two U-shaped springs.

11 Claims, 8 Drawing Sheets

FACIAL CLEANING BRUSH AND RELATED COMPONENTS

CROSS-REFERENCE TO RELATED APPLICATION

This application claims priority to Chinese Patent Application No. 201520750770.8, filed Sep. 25, 2015, the entirety of which is incorporated by reference.

FIELD OF THE INVENTION

The present invention relates generally to facial cleaning brushes, and, more particularly, relates to a facial cleaning brush including a brush head assembly.

BACKGROUND OF THE INVENTION

Facial cleaning brushes usually consist of outer shell, brush head assembly, motor head which powers the brush head, connecting devices between the brush head assembly and motor head. Current technology makes the brush head assembly complicated, which is hard to disassemble or install. Thus a new design of the brush head assembly is needed for easier operation.

Therefore, a need exists to overcome the problems with the prior art as discussed above.

SUMMARY OF THE INVENTION

The invention provides a facial cleaning brush and related components that overcomes the hereinafore-mentioned disadvantages of the heretofore-known devices and methods of this general type and that provides a relatively small brush head that provides a large cleaning surface to improve cleaning efficiency.

With the foregoing and other objects in view, there is provided, in accordance with the invention, a facial cleaning brush that has an outer shell coupled with a brush head assembly with a brush head housing surrounding a motor head operably configured to supply power for a movement of the brush head. The brush head assembly includes a brush head having an anchoring plate with a plurality of bristles coupled to a front face of the anchoring plate, wherein the anchoring plate including a first anchoring point. The brush head assembly also includes at least two U-shaped springs coupled to the anchoring plate and a brush head anchoring unit with a second anchoring point selectively removably coupled to the first anchoring point, wherein the first and second anchoring points interposed between the at least two U-shaped springs.

In accordance with another feature, an embodiment of the present invention includes a plurality of holes defined by the brush head anchoring unit, wherein the brush head is selectively removably coupled to the brush head anchoring unit through the plurality of holes.

In accordance with a further feature of the present invention, the second anchoring point is of a cylindrical shape extending to the first anchoring point disposed on a back of the anchoring plate.

In accordance with an additional feature of the present invention, the at least two U-shaped springs are disposed circumferentially around the second anchoring point.

In accordance with yet another feature, an embodiment of the present invention includes an outer ring surrounding the brush head and including at least one spiral groove, wherein the at least one spiral groove sized to receive at least one fixing point protruding from the brush head housing and is operably configured to at least partially limit longitudinal movement of the brush head when coupled to the motor head so as not to separate from the brush head housing.

In accordance with another feature, an embodiment of the present invention also includes a plurality of perforated anchor points disposed on a back of the anchoring plate, the plurality of perforated anchor points sized to respectively receive a plurality of protrusions disposed on the brush head housing.

In accordance with a further feature, another embodiment of the present invention includes a soundproofing o-ring coupled to the brush head and interposed between the brush head and the outer ring.

In accordance with another feature, an embodiment of the present invention includes an outer decorating ring disposed at a front end of the brush head, the outer decorating ring having a plurality of matching grooves sized to correspond with a portion of the outer ring. The outer decorating ring and/or outer ring may have barbs that facilitate in coupling with one another in the matching grooves.

In accordance with a further feature of the present invention, the soundproofing o-ring is interposed between a front wall of the outer decorating ring and the outer ring and between a side wall of the outer decorating ring and the anchoring plate of the brush head.

In accordance with yet another feature, an embodiment of the present invention includes a vibration dampening device disposed between the brush head housing and a back wall of the outer ring.

Although the invention is illustrated and described herein as embodied in a facial cleaning brush and related components, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to a direction in which the brush head is inserted into the brush head housing and coupling with the motor head of the facial cleaning brush.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
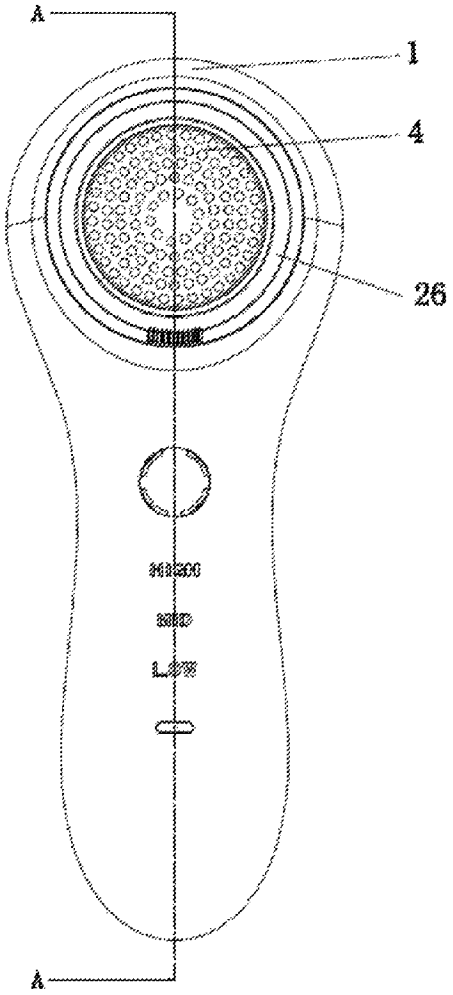
FIG. 1 is an elevational front view of a facial cleaning brush.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Based on the shortcomings of current brush head assemblies on the market, this new utility design solves the connecting difficulties between the brush head assembly and the motor head. The design is structurally simple, easy to assemble, and promotes stability of the assembly during operation.

In order to achieve the above results, the new utility design contains the following technology scheme described herein. The new utility design is a new facial cleaning brush and its components. In one embodiment, the facial cleaning brush and the related components may include an outer shell, brush head assembly, and a brush head motor device. The design may include a housing for brush head installation on the outer shell. In one embodiment, the housing houses the motor head that powers the movement of the brush head. The brush head assembly includes a brush head and two anchoring points. The second anchoring point fits together with the first anchoring point. The brush head also includes a base plate having bristles attached thereto, as well as two springs. The brush head anchoring points are disposed between the two springs, the springs being of a "U" shape. Such configuration achieves the perfect fit between the brush head and the housing with a relatively simple structure and strong stability.

Advantageously, in one embodiment, the anchoring plate may have multiple holes for fitting purposes. The anchoring plate has multiple positioning points to aid the fit of the brush head with its housing. The brush head assembly will fit into the holes for a perfect fit.

In one embodiment, the anchoring plate, the second connecting point, and the limit portion fit together. This second connecting point extends to the back of the anchoring plate in a cylindrical style. The springs are distributed in a circle around the cylinder of the anchoring plate. The housing for the brush head assembly contains perforating points for fitting purposes. There is an outer ring for the brush head, which contains spiral grooves which limits the movement of the brush head when the unit is on and spinning, ensuring that the brush head does not separate from the brush head housing.

In one embodiment, a soundproofing o-ring is disposed between the brush head and its outer ring.

In one embodiment, there is an outer decorating ring disposed near a front end of the brush head. The decorating ring has grooves for fitting purposes.

In one embodiment, the soundproofing o-ring sits in a cavity between the decorating rings and the anchoring plate. The front wall of the soundproofing o-ring is located between the front wall of the decorating ring and grooves in the anchoring plate. The back wall of the soundproofing o-ring sits between the brush head outer ring and the anchoring grooves.

In one embodiment, the brush head assembly contains a vibration dampening device. This dampening device sits between the brush head housing and the back wall of the brush head outer ring.

This new utility design offers strong advantages and better results when compared to the current existing technology. In particular, this new design features a unique structure that connects the brush head with its housing. It is structurally simple and easy to assemble and install. It also features excellent stability during operation. The smart connecting method utilizes screw type of fitting. This design ensures that the brush head can be small yet offer larger cleaning surface, which improves cleaning efficiency.

In order to better explain this new utility design's structural features and results, device figures and operating instructions may be included.

Figure 2:
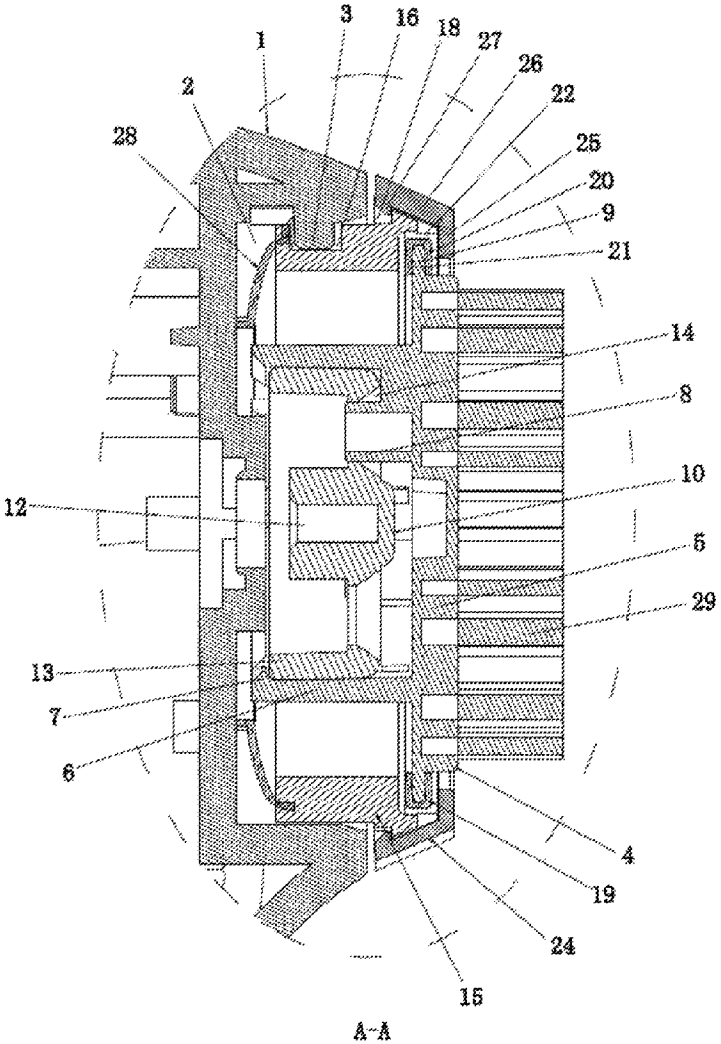
FIG. 2 is a partial cross-sectional view of the facial cleaning brush taken along cross section A-A of FIG. 1 in accordance with the present invention.
Figure 3:
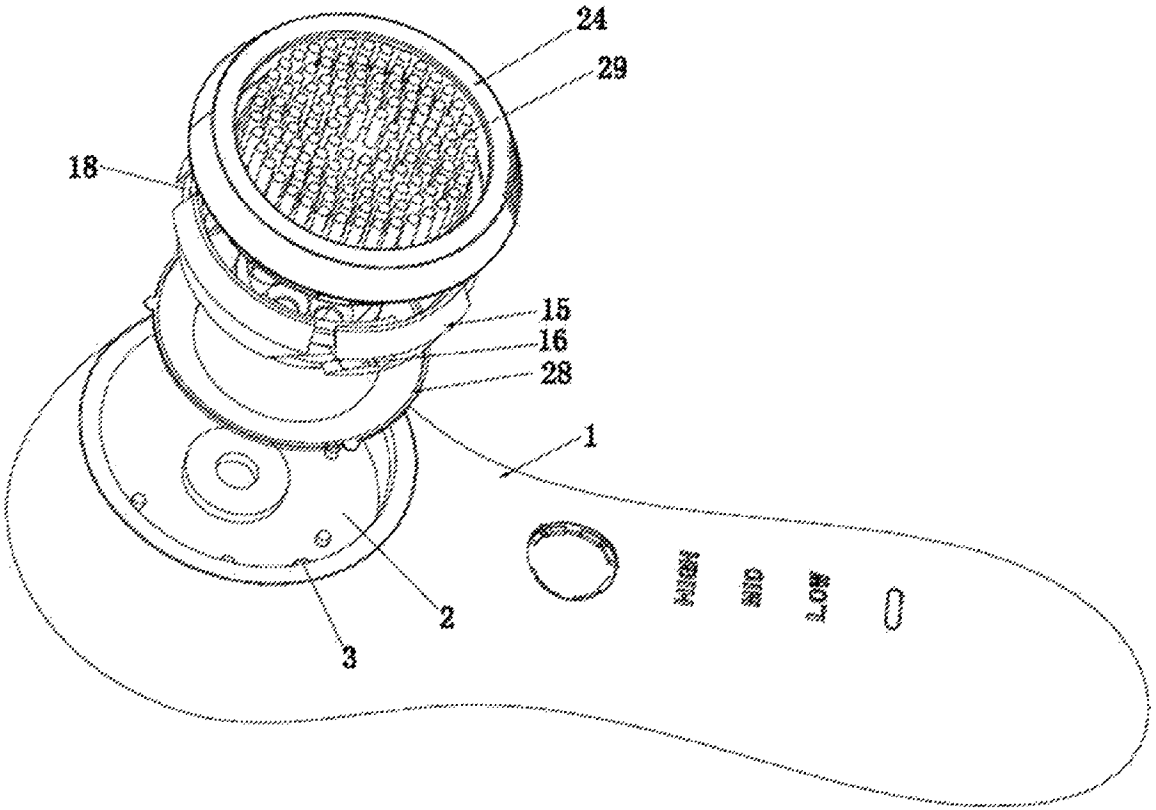
FIG. 3 is an exploded view of the facial cleaning brush of FIG. 1.
Figure 4:
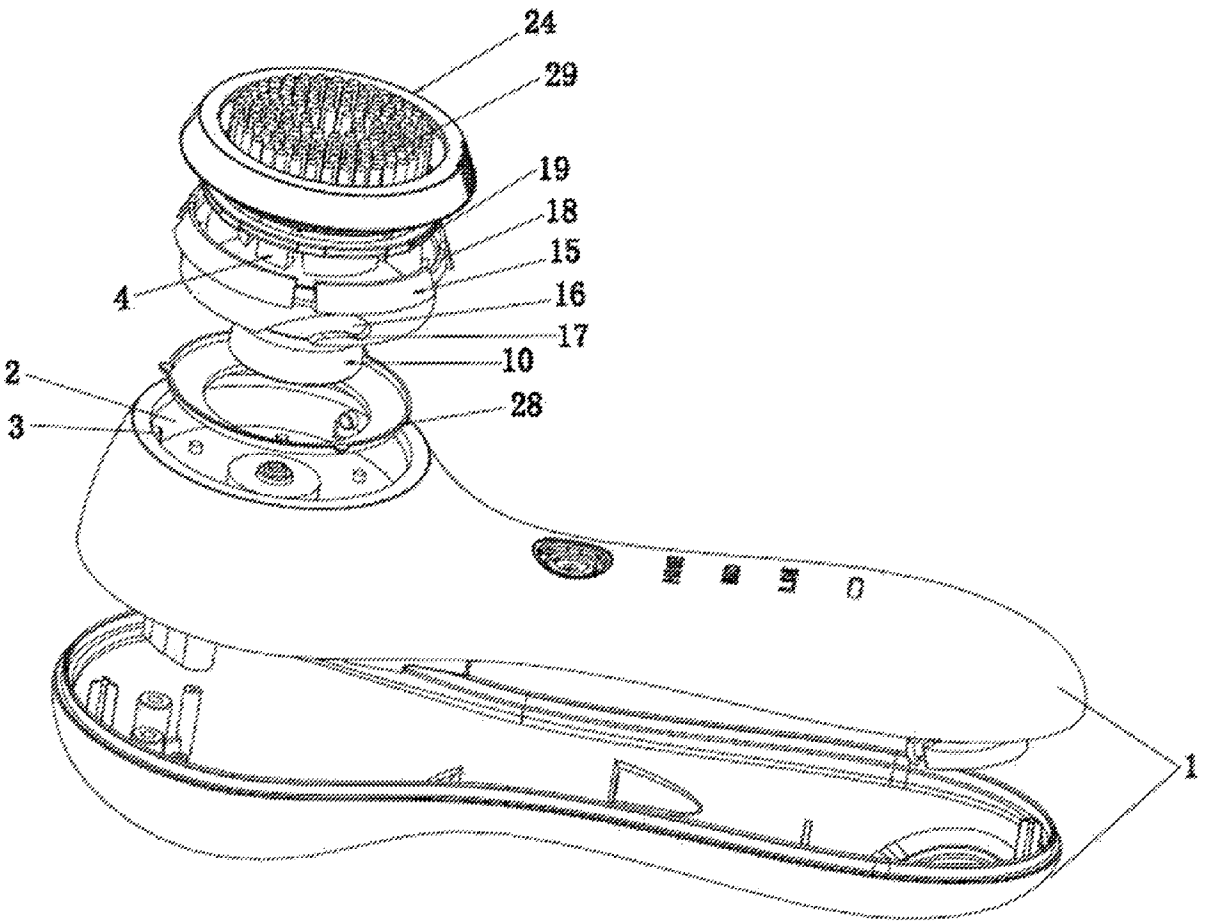
FIG. 4 is another exploded view of the facial cleaning brush of FIG. 1.
Figure 5:
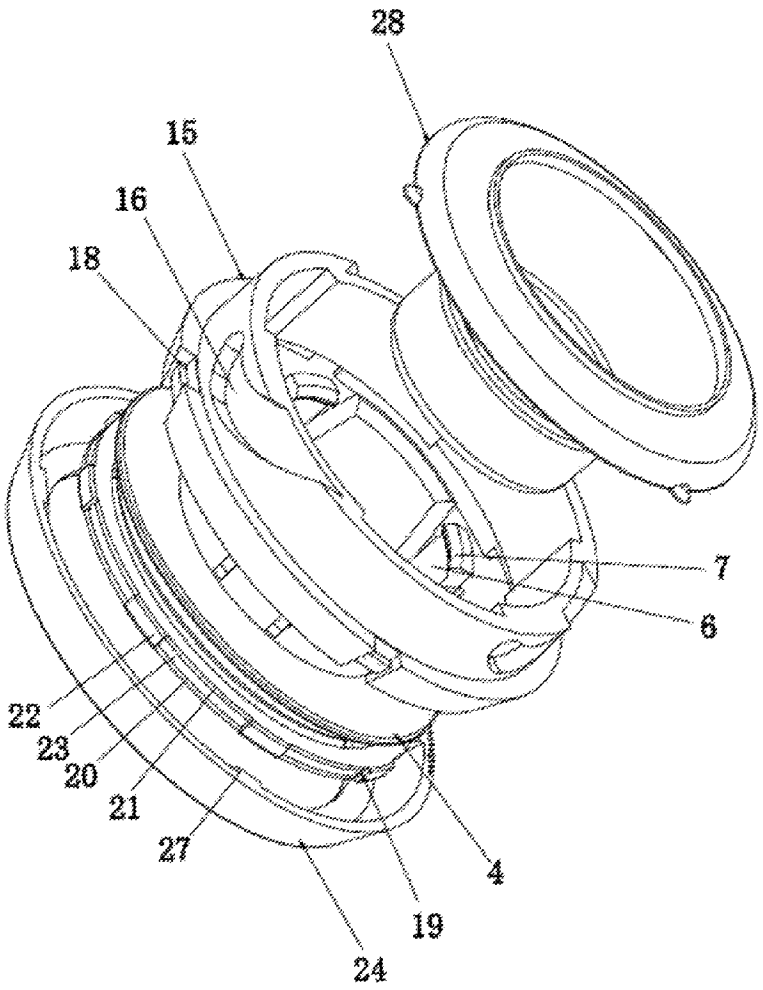
FIG. 5 is an exploded view of a brush head assembly depicted in FIG. 1.
Figure 6:
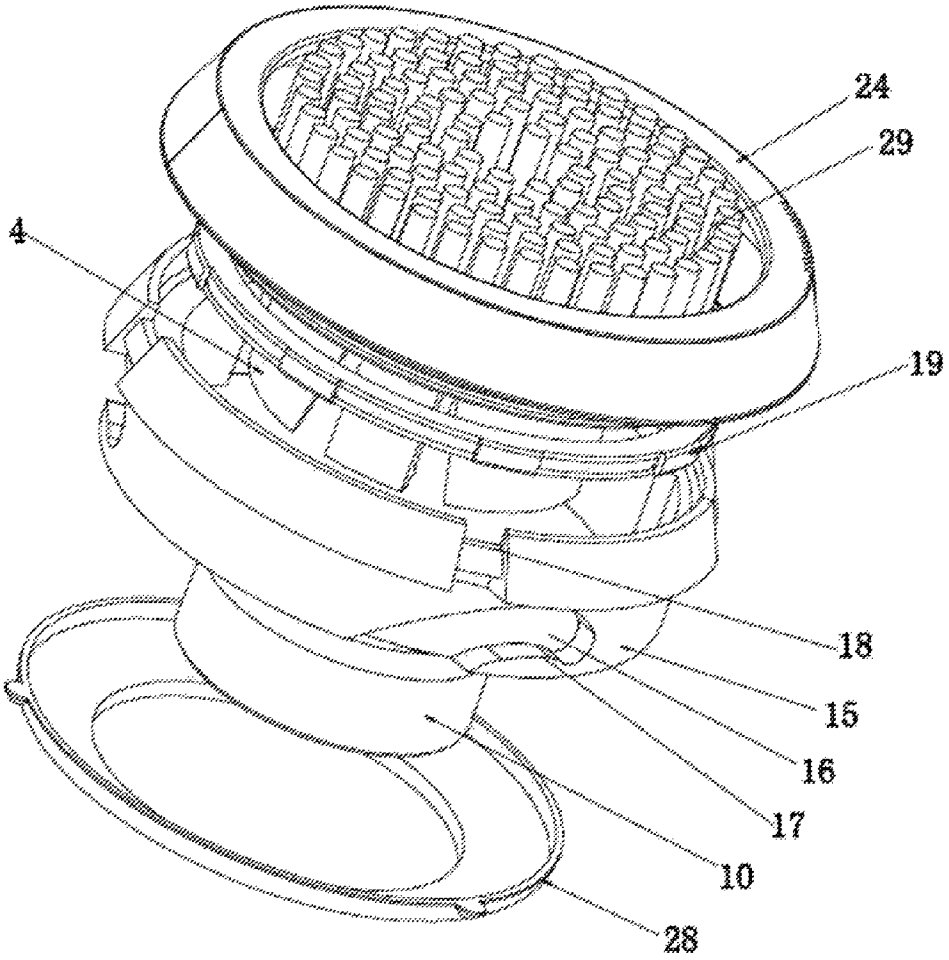
FIG. 6 is another exploded view of the brush head assembly of FIG. 1.
Figure 7:
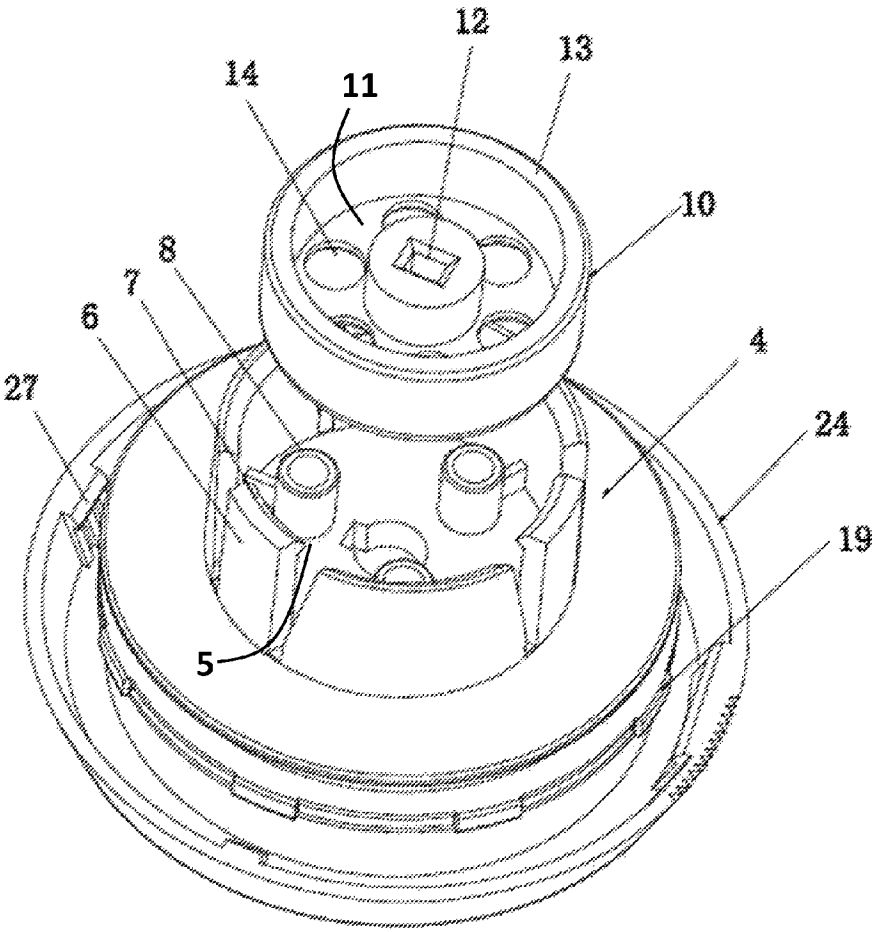
FIG. 7 is a perspective rear view of the brush head assembly in a partially dissembled configuration in accordance with the present invention.
Figure 8:
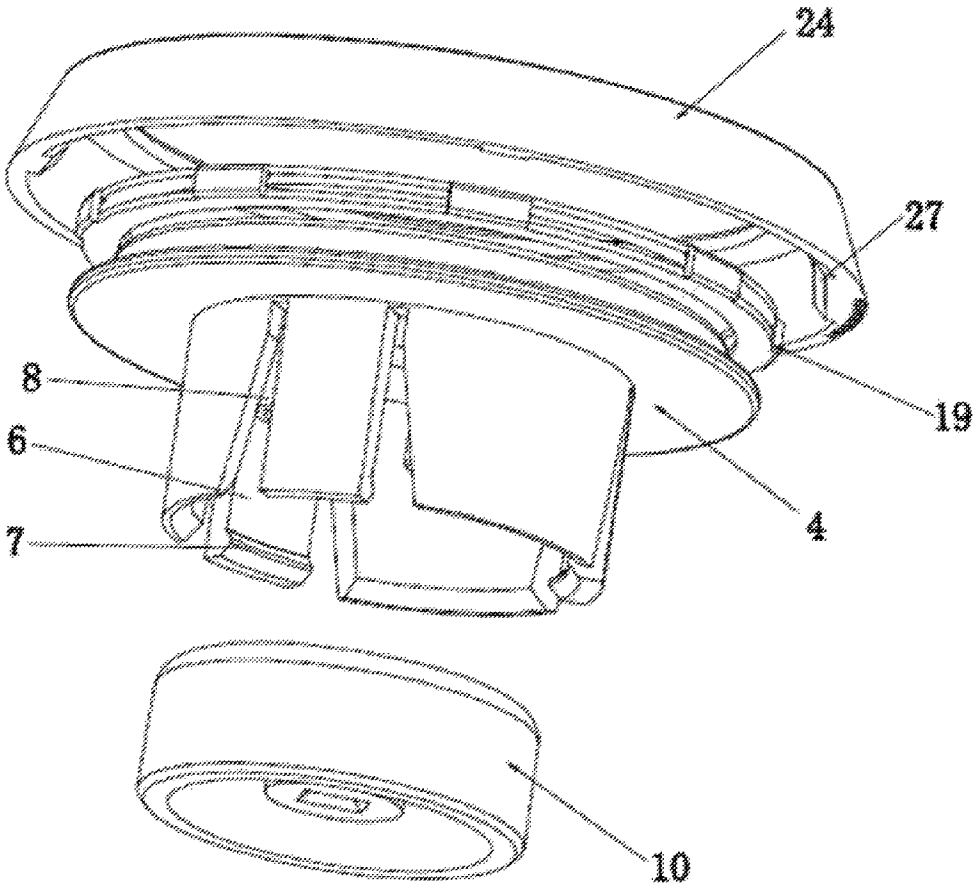
FIG. 8 is a perspective upward-looking view of the brush head assembly in a partially dissembled configuration in accordance with the present invention.

Referring now to FIGS. 1-8, various embodiments of the present invention are shown. FIGS. 1-8 show several advantageous features of the present invention, but, as will be described below, the invention can be provided in several shapes, sizes, combinations of features and components, and varying numbers and functions of the components. In one embodiment, the new design for the facial cleaning brush and the related components includes an outer shell (1), a brush head assembly, and a motor head. The outer shell (1) contains a brush head housing (2) and inside the housing (2) situates the first connecting point for the motor head.

The brush head assembly contains brush head (4), brush head anchoring unit (10), vibration dampening device (28), soundproofing o-ring (19) and brush head outer ring (15). In one embodiment, the structure of the brush head assembly includes the brush head (4) having a base plate and brush head anchoring unit (10) for fixing the bristles (29). The brush head anchoring unit (10) contains at least two limiting spring arms (6), which hook to the barb (7). The limiting spring arms (6) are fixed to the anchoring plate (5) and are located in a circular configuration.

The brush head anchoring unit (10) contains fixing plate (11) and second connecting point (12) and the limiting portion (13) fixed on the brush head anchoring unit (10) to prevent the slippage of the brush head (4). The brush head anchoring unit (10) and fixing plate (11) have multiple fixing chambers (14). The brush head (4) and its anchoring plate (5) contain multiple perforating anchoring points (8). The brush head (4) may be fixed to the brush head anchoring unit (10) and the perforating anchoring points (8) may plug into fixing chambers (14). The second connecting point (12) fits with the previously mentioned first connecting point. The brush head anchoring unit (10) sits between the two limiting spring arms (6). The limiting spring arms (6) hook on the barb (7), which all connect to the limiting portion (13). The anchoring plate (5), the second connecting point (12), and the limiting portion (13) are all connected together. The second connecting point (12) extends to the back of the anchoring plate (5). The limiting portion (13) is distributed in a cylindrical configuration along the outside of anchoring plate (5).

The brush head outer ring (15) contains spiral grooves (16). These grooves (16) may contain anti-slip grooves (17) to prevent the outer ring (15) from slipping. In one embodiment, the brush head housing (2) contains fixing points (3). When the brush head outer ring (15) is installed in the housing (2) and are the components are operating, the fixing points (3) fit into the spiral groove (16), which limits its movement in the anti-slip grooves (17).

In one embodiment, one side of the vibration dampening device (28) is fixed to the housing (2), while the opposing side is fixed to the rear of outer ring (15). The vibration dampening device (28) is in roughly a ring-like configuration. There are multiple supporting points in the front of the ring to fit to the outer ring (15).

The soundproofing o-ring (19) is situated between the outer ring (15) and brush head (4). The front wall (20) and rear wall (21) are connected to the connecting arm (22) and then to the groove (23). The side of the anchoring plate (5) for brush head (4) contains perforating point (9). The perforating points (9), soundproofing o-ring (19) fits inside the groove (23). The brush head (4) contains decorating ring (24) on the outside. This ring has a front wall (25) and side wall (26). The side wall (26) contains a barb (27). The outer ring (15) fits to its matching groove (18). The cylindrical side wall (26) covers the outer ring (15). The barb (27) sits in the groove (18). The front wall (20) of the soundproofing o-ring (19) is located between the front wall (25) of decorating ring (24) and the perforating points. The rear wall (21) of the soundproofing o-ring (19) is located between the outer ring (15) and perforating points (9).

The new design achieves the perfect fit between the brush head and the housing with a relatively simple structure with strong stability. The design also offers ease in the assembly and installation of the brush head assembly. The outer ring of the brush head screws into the housing, which makes for the easy operation for the user. This design ensures that the brush head can be small yet offer larger cleaning surface, which improves cleaning efficiency.

Based on the previous description, this is only the best solution to the design, it does not limit the invention limits in any way shape or form. So slight alteration for the production models will still be within the scope of this invention.

What is claimed is:

1. A facial cleaning brush comprising:

an outer shell coupled with a brush head assembly with a brush head housing surrounding a motor head operably configured to supply power for a movement of the brush head, the brush head assembly having:

a brush head having an anchoring plate with a plurality of bristles coupled to a front face of the anchoring plate, the anchoring plate including a first anchoring point;

at least two U-shaped springs coupled to the anchoring plate; and a brush head anchoring unit with a second anchoring point selectively removably coupled to the first anchoring point, the first and second anchoring points interposed between the at least two U-shaped springs.

2. The facial cleaning brush according to claim 1, further comprising:

a plurality of holes defined by the brush head anchoring unit, wherein the brush head is selectively removably coupled to the brush head anchoring unit through the plurality of holes.

3. The facial cleaning brush according to claim 2, wherein:

the second anchoring point is of a cylindrical shape extending to the first anchoring point disposed on a back of the anchoring plate.

4. The facial cleaning brush according to claim 3, wherein:

the at least two U-shaped springs are disposed circumferentially around the second anchoring point.

5. The facial cleaning brush according to claim 1, further comprising:

an outer ring surrounding the brush head and including at least one spiral groove, the at least one spiral groove sized to receive at least one fixing point protruding from the brush head housing and operably configured to at least partially limit longitudinal movement of the brush head when coupled to the motor head so as not to separate from the brush head housing.

6. The facial cleaning brush according to claim 1, wherein the brush head further comprises:

a plurality of perforated anchor points disposed on a back of the anchoring plate, the plurality of perforated anchor points sized to respectively receive a plurality of protrusions disposed on the brush head housing.

7. The facial cleaning brush according to claim 6, further comprising:

an outer ring surrounding the brush head and including at least one spiral groove, the at least one spiral groove sized to receive at least one fixing point protruding from the brush head housing and operably configured to at least partially limit longitudinal movement of the brush head when coupled to the motor head so as not to separate from the brush head housing.

8. The facial cleaning brush according to claim 7, further comprising:

a soundproofing o-ring coupled to the brush head and interposed between the brush head and the outer ring.

9. The facial cleaning brush according to claim 8, further comprising:

an outer decorating ring disposed at a front end of the brush head, the outer decorating ring having a plurality of matching grooves sized to correspond with a portion of the outer ring.

10. The facial cleaning brush according to claim 9, wherein:

the soundproofing o-ring is interposed between a front wall of the outer decorating ring and the outer ring and between a side wall of the outer decorating ring and the anchoring plate of the brush head.

11. The facial cleaning brush according to claim 9, further comprising:

a vibration dampening device disposed between the brush head housing and a back wall of the outer ring.

* * * * *